US007913477B2

(12) United States Patent
Harper

(10) Patent No.: US 7,913,477 B2
(45) Date of Patent: Mar. 29, 2011

(54) INSERT REGISTRATION IN PACKETS

(76) Inventor: William Anthony Harper, Redmond, WA (US)

( * ) Notice: Subject to any disclaimer, the term of this patent is extended or adjusted under 35 U.S.C. 154(b) by 1057 days.

(21) Appl. No.: 11/487,927

(22) Filed: Jul. 17, 2006

(65) Prior Publication Data

US 2007/0175181 A1 Aug. 2, 2007

Related U.S. Application Data

(60) Provisional application No. 60/763,085, filed on Jan. 27, 2006.

(51) Int. Cl.
*B65B 9/06* (2006.01)
*B65B 9/08* (2006.01)

(52) U.S. Cl. ..... 53/451; 53/452; 53/455; 53/548

(58) Field of Classification Search ..... 53/451, 53/452, 455, 548, 550, 553, 415, 469
See application file for complete search history.

(56) References Cited

U.S. PATENT DOCUMENTS

| | | | | |
|---|---|---|---|---|
| 3,319,538 | A * | 5/1967 | Bodolay et al. | 53/415 |
| 4,290,467 | A * | 9/1981 | Schmidt | 383/9 |
| 4,779,397 | A * | 10/1988 | Christine et al. | 53/410 |
| 4,897,273 | A * | 1/1990 | Kotaki et al. | 426/118 |
| 5,140,727 | A * | 8/1992 | Dais et al. | 24/585.12 |
| 5,505,037 | A * | 4/1996 | Terminella et al. | 53/133.4 |
| 5,564,259 | A * | 10/1996 | Stolmeier | 53/410 |
| 6,041,575 | A * | 3/2000 | Vonderhorst et al. | 53/415 |
| 6,047,521 | A * | 4/2000 | Terminella et al. | 53/133.4 |
| 6,145,282 | A * | 11/2000 | Tsuruta | 53/551 |
| 6,234,944 | B1 * | 5/2001 | Anderson et al. | 493/210 |
| 6,823,650 | B2 * | 11/2004 | Recchia, Jr. | 53/415 |
| 6,834,474 | B2 * | 12/2004 | Dutra et al. | 53/133.4 |
| 6,860,084 | B2 * | 3/2005 | Knoerzer et al. | 53/133.4 |
| 6,865,860 | B2 * | 3/2005 | Arakawa et al. | 53/412 |
| 6,968,669 | B2 * | 11/2005 | Schroeder et al. | 53/410 |

* cited by examiner

*Primary Examiner* — Rinaldi I Rada
*Assistant Examiner* — Gloria R Weeks

(57) ABSTRACT

A method for precise registration of inserts in web formed packaging is provided in which insert placement occurs following the start of the package build. Registration is maintained through the build and product deposit steps by external gripping of the insert.

23 Claims, 2 Drawing Sheets

INSERT REGISTRATION IN PACKETS

The present application claims priority to provisional application No. 60/763,085, filed 27 Jan. 2006, entitled "Insert Registration in Packets".

FIELD OF THE INVENTION

This invention generally relates to an apparatus and method for placing inserts inside a flexible package, such as a packet, containing a product.

BACKGROUND OF THE INVENTION

The placement of inserts within flexible packaging has long been and continues to be an important means of identifying and marketing products. The actual methods employed, the when and how descriptions, for precise placement and registration of inserts has produced numerous patents and other art. Representative of these are means to establish and maintaining proper registration of the insert as the package is built around it, strategies to clear failures with minimal operational delay, methods of material changeover without production shutdown, approaches to reduce material wastage, and techniques to avoid package spoilage where insert placement adversely effects marketability. More effective means offering solutions to these and other problems are continually being sought as novel improvements to the packaging art.

One example of current prior art representative of such means is where an article is stuck to a web surface that eventually becomes the interior of a flexible package as described in U.S. Pat. No. 6,041,575 to Vonderhorst et al. Therein Vonderhorst describes an operation where an article is attached to a moving web of film that is subsequently folded, formed into a package, filled with product, then sealed and cut from the web to form a single package with the article and product both sealed within. The key patentable feature in is that the article is attached to the web by adhesive means just before the fold operation creates the package tube so there is little opportunity for the article to be displaced or dislodged by subsequent web manipulations in building the enveloping package. Vonderhorst recites a history of problems associated with other methods of insert placements commonly found in a packaging operations characterized as vffs (vertical-form-fill-seal) machines and lays the basis for novel claims overcoming previous limitations.

However, the Vonderhorst solution of sticking an article on the web before web modification creates new concerns. The article must be adaptable to receiving and maintaining a quick acting adhesive of sufficient strength to securely attach the article to the web; not all articles have this adaptability. The adhesive should not disfigure the article or the package material; few adhesive have this characteristic. The adhesive must not contaminate or damage in any way the product sealed within the package; adhesive are notorious for affecting products like food with off flavors. The article may require removal from the package for a further use such as with coupons; an adhesive strip on the article is undesirable. The article may be designed to freely move within the enclosed product only constrained by the package boundaries; adhesive attachment prevents this marketing feature. Alternatively, the article's adhesive hold on the interior wall may interact with the product, detach from the interior wall, pickup product on the adhesive, and move freely within the package; a detached, hidden insert with clumps of product stuck to its adhesive somewhat negates its purpose and value.

These and other disadvantages indicate there are still unresolved problems within the prior art.

Accordingly, there remains a need for an apparatus and method for applying articles such as inserts within flexible packages, like packets, which ensures accurate and secure registration while maintaining efficient packet building, successful product filling, and secure sealing in a standard packaging operation like vffs. The present invention recognizes the foregoing prior art and specifically addresses their individual and collective shortcomings and disadvantages.

SUMMARY OF THE INVENTION

In accordance with a generalized description of the present invention, a moving polymeric web used for packaging enters an operational station where it is folded to form two sidewalls, the fold is creased forming a distinct edge, and the two opposite edges of the sidewalls formed by the web are subsequently spread apart. At the next station an insert is pushed into the v-shaped web form through the momentary opening to lodge at the far creased interior edge, an exterior gripping action closes on the exterior surface of the sidewalls near the crease so as to grip the insert through the web sidewalls and securely registering it in place. The exterior pressure, gripping the web and insert, moves with the web to the next operation where a sealing station creates various horizontal and vertical seals that joins both sidewalls at predetermined locations so as to substantially define a package capable of containing a product which is now deposited by means of tubes extending up between the web sidewalls and exiting at a point beyond the newly created seals to reach a supply point. After the product has been deposited, the web and gripped insert move to a second sealing station beyond the product tube extension where various seals are applied joining the sidewalls at predetermined points so as to completely seal the now formed individual package containing insert and product. The web moves to the next station where the individual package is severed from the web and transported for further processing.

The sealing means used to join various components can be quite varied as well known to those skilled in the art. Among these means are heat, radiation, mechanical, pressure, light, sound, adhesives, and like commonly used techniques for sealing. The gripping means used to grip the insert through the web sidewalls can be mechanical, pneumatic, hydraulic, tension, and like commonly used techniques suitable for gripping. The product to be package can be a liquid, fluid, gel, cream, solid, powder, granule, gas and the like.

It is an object of the present invention to overcome the disadvantages of earlier art by providing an insert registration apparatus and method for the accurate and reliable construction of a package containing an insert and product by employing late-stage side insertion (LSI) technology.

Another object of the present invention is to provide positive insert placement and registration by gripping means of both web and insert for folded web vffs systems producing 3-seal packets.

Still another object of the present invention is to provide positive insert placement and registration by gripping means for a multiple web vffs system producing 4-seal packets.

Still another object of the present invention is to provide precise, positive web registration for both sequential and concurrent station actions.

Still another object of the present invention is to permit post-insertion tacking of insert to at least one sidewall.

Still another object of the present invention is to minimize the cost associated with placing an insert within a package by avoiding article modification to permit registration.

Still another object of the present invention is to permit placement of inserts varying in type in respect to shape, size, thickness, weight, stiffness, numbers, orientation, content, and similar characterizing features.

Still another object of the present invention is to minimize insert interfering with sealing operations that creates wastage and disruption.

Still another object of the present invention is to permit a predetermined variation of the insert location with each insertion.

Still another object of the present invention is to permit a predetermined variation of the type of insert selected for each insert.

Still another object of the present invention is to prevent dislodgement of the insert during web movement and package build activity.

Still another object of the present invention is to permit easy changeover of insert types without disrupting web movement and operations.

These and other objects and advantages of the present invention will become apparent from the following description taken in conjunction where appropriate with the accompanying drawings wherein are set forth, by way of illustrations and example, certain embodiments of this invention. The drawings constitute a part of this specification and include exemplary embodiments of the present invention and illustrate various objects and features thereof.

BRIEF DESCRIPTION OF THE DRAWINGS

The invention will be better understood and objects other than those set forth above will become apparent when consideration is given to the following detailed description thereof. Reference is made in the following briefly described drawings, wherein like reference numbers refer to corresponding elements.

DETAILED DESCRIPTION OF THE INVENTION

While the invention will be described in connection with illustrations, descriptions, and example of a preferred embodiment, it will be understood these are not intended to limit the present invention only to these embodiment. On the contrary, the present invention is to cover all structural and/or functional alternatives as generally described.

Figure 1:
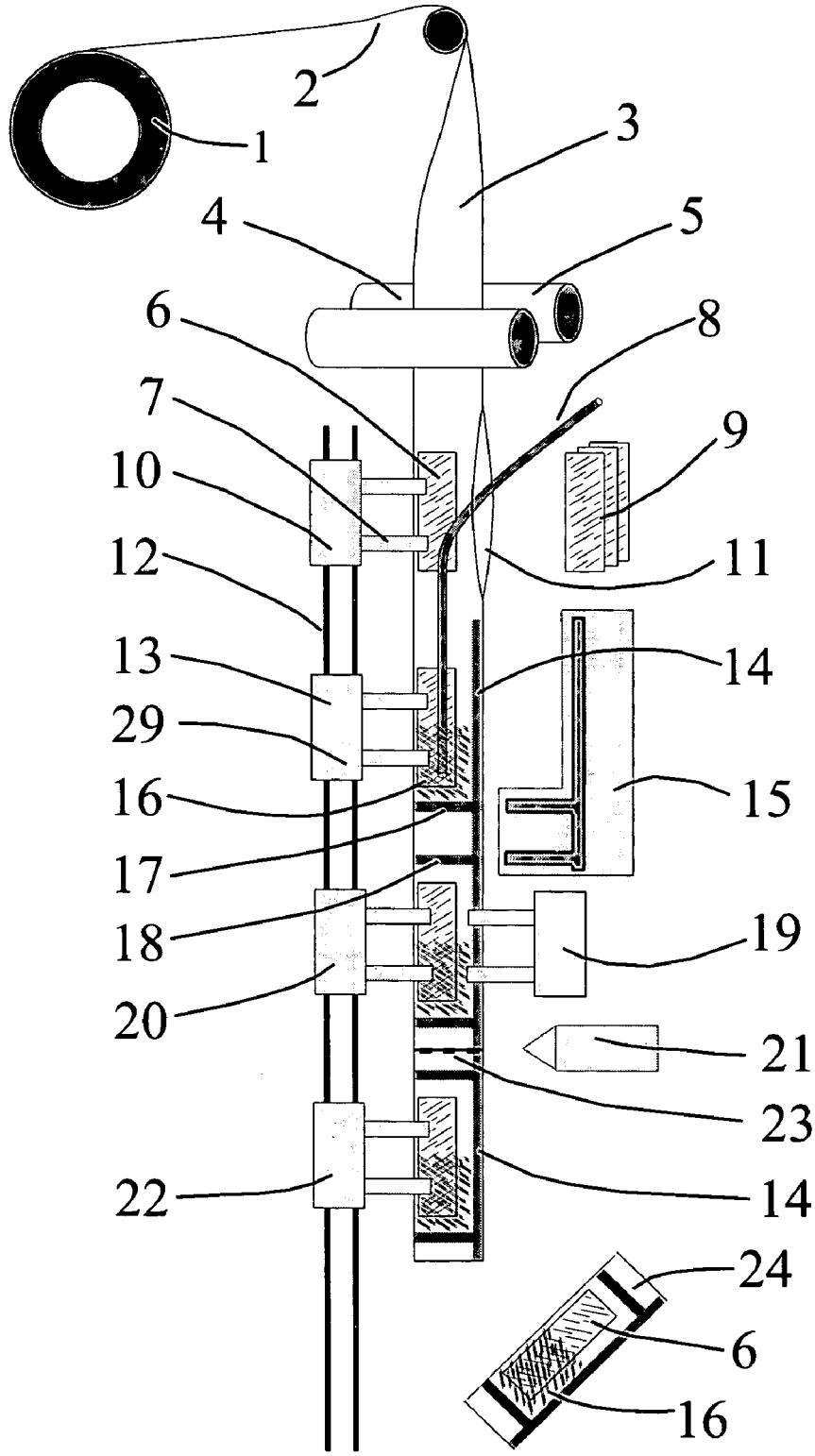
FIG. 1 illustrates a particular single folded web embodiment of a 3-seal vffs machine with a gripped insert registration means according to the teachings of the present invention
Figure 2:
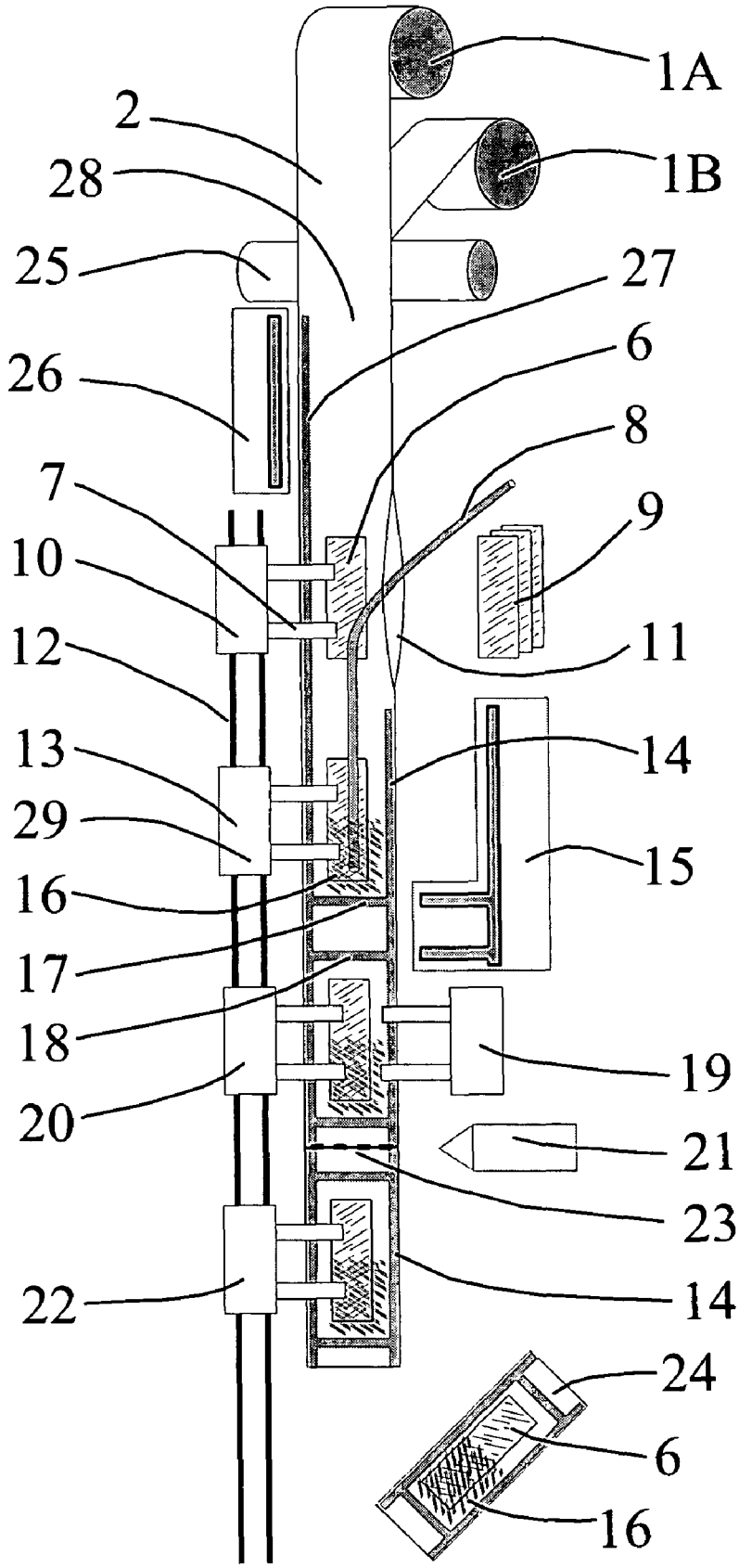
FIG. 2 illustrates a particular dual web embodiment of a 4-seal vffs machine with gripped insert registration according to the teachings of the present invention.

Both FIG. 1 and FIG. 2 show particular embodiments of a method for making packet packages according to the teachings of the present invention. Although the present invention is described in connection with two types of vffs machines, it does not preclude the described method of the present invention working equally well in others types of packaging machines such as horizontal packers. In FIG. 1 a 3-seal type of vffs machine is illustrated where a single role 1 of flexible web material 2 is folded 3 in half with a crease 4 formed between thus formed sidewalls requiring three seals to create an enclosed package with the fold crease 4 providing the fourth closing element. In FIG. 2 a 4-seal type of vffs machine is illustrated where two roles 1A, 1B of flexible web material 2 are layered and aligned to form two sidewalls requiring four seals to create an enclosed package with seals providing all closure elements. It should be understood that while vertical designs are illustrated, the present invention applies as well to horizontal machines and all other packaging machines utilizing web technology.

As shown in FIG. 1, role 1 of flexible web material 2 is provided. The material 2 is folded 3 in half to form a crease 4 with two resulting sidewalls that pass through crease rollers 5 to set the crease 4 and flatten the resulting web form. After the rollers 5 the folded web 3 is spread apart at the first operational station 10 by a fixed inline guide located between the two sidewalls to form a side opening 11 suitable for allowing two operational steps. The first step is a fixed product tube 8 that may act as the inline guide accessing the interior of the folded web 3 for depositing product 16 content into a package 24 as the package 24 is built from the passage of the folded web 3 through several operational stations. The second step occurring at the side opening 11 is the placement of one or more insert 6 from an external source 9 into the interior of the folded web 3 so the insert 6 is located between the sidewalls and held in place by external pressure gripping 7 the folded web 3 sidewalls and the insert 6 located in the interior defined by the sidewalls.

The folded web 3 moves to the next operational station 13 with the gripping 7 action and its transport 29 running on guides 12 continuing to maintain a gripping 7 hold on the corresponding folded web 3 sidewalls and the interior insert 6. At this second station 13 location a sealing mechanism creates seals at predetermined locations on the folded web 3 where first and second sidewalls are sealed together to partially define a flexible package 24 containing an insert 6. In this specific embodiment as illustrated in FIG. 1, the sealing mechanism uses heat to partially melt the polymeric film of the folded web 3 to form a side seal 14 and bottom seal 17 of one package 24, while simultaneously forming the closing top 18 seal of the just proceeding package 24. Following the partial build of the package 24 the product tube 8 dispenses a predetermined amount of product 16 into the just formed partial package 24 formed in the folded web 3.

The folded web 3 moves to the next operational station 20 with the gripping 7 action and its transport 29 continuing to maintain a gripping 7 hold on the corresponding folded web sidewalls and the interior insert 6. At the third station 20 a fixed grip 19 mechanism holds and stabilizes the folded web 3 so the sealing mechanism 15 completes its cycle by finally sealing the package now that movement of the folded web 3 has removed the product tube 8 from the interior of the package 24. Also at this station a cutting mechanism 21 severs the package 24 from the folded web 3 by means of a cut 23 of the web material.

The severed package 24 moves to the next operational station 22 with the gripping 7 action and its transport 29 continuing to maintain a grasp 7 on the corresponding now severed segment of folded web that constitute the package 24 sidewalls and the interior insert 6. At the fourth station 22 any further operations such as trimming, nicking, sorting, and like processing can be undertaken. In FIG. 1 the package 24 with insert 6 and product 16 is shown after the fourth station 22 as an independent 3-seal package available for subsequent use.

In FIG. 2 the same operations described in the FIG. 1 walkthrough are found in the same sequence, performing the same functions. What is different in FIG. 2 is the use of two roles 1A, 1B of flexible web material 2 that is not folded as in FIG. 1 but layered. This arrangement permits the two web 28 sidewalls to have different properties. For example, the upper web 1A material may be a clear polymeric laminate while the lower web 1B material is an opaque preprinted laminate with foil and/or paper components in a flexible web 2. Numerous combinations of materials with widely ranging properties are possible. The additions of a preliminary web sealing stations 26 creates a first seal 27 joining the webs 1A, 1B into a single layered web 28 for further processing in a similar manner to that described for FIG. 1.

With description of the operational walkthroughs of FIG. 1 and FIG. 2 it is understood the late-stage side insertion (LSI) technique where a gripping action firmly holds a precisely placed insert within the web has several new and clearly identifiable advantages over prior methods. For example, by delaying the step where the insert interfaces with the web until after the web is folded and otherwise manipulated there is a significant improvement over Vonderhorst where the article is introduced before this maneuver. Key objectives of Vonderhorst were to minimize the likelihood an article would be dislodged from the web during package formation; the present invention reduces that risk by several magnitudes further because of its immediate proximity to the package build operation. There is a discernibly, quantifiable quantum reduction, a much reduced opportunity for error by use of LSI technology.

By gripping a precisely placed insert in both 3-seal and 4-seal operations both placement and its corresponding registration to other features of the package such as seal boundaries are exactly maintained. In web packaging the common distortion of the web material is caused by many factors, not the least of which is simply its rapid manipulation leading up to the build process. For package designers even small variations create major alignment problems when close tolerances must be achieved in the package build around given insert dimensional realities, the issue is solved by providing generous error margins that produce material wastage, sloppy product appearance, and limited design options. By precise placement and maintaining precise reference for all subsequent operation a degree of operational registration can be achieved greater than ever before. For example, because of precise placement an insert can now fill an entire packet, seal to seal in all directions, without compromising seal integrity by a slight misplacement due to material distortion, insert slippage, or a wandering web. Material waste reduction and expanded design opportunities are only two of the significant benefits of LSI technology attributable to the present invention.

While precise placement and reference registration are significant, there is another advantage attributable to the present invention, for example package build insert attachment. While past art somehow affixed the article to the web prior to build, it is now desirable to eliminate that separate operation and combine it with the actual build operation. For example, a polymer insert with suitable thermal characteristics could be tacked or joined with one or more interior wall or even product by a heat sealing element during the during the package build operation and require no separate or additional step. By tacking the insert to a sidewall the insert remains in a specific location, does not introduce foreign materials to the interior, and can provide other benefits such as stiffness for structural integrity to the package. A tacked insert can also provide protection from pilfering and outright theft of the package and/or product. By combining insert attachment with the package build operation a significant operational economy is newly achieved.

Package inserts are not all the same; they vary in shape, size, thickness, weight, stiffness, numbers, orientation, content, communication and many more characterizing features. With LSI technology it becomes possible to accommodate widely ranging insert types with minimal material wastage, changeover adjustments, and production delays. Because the inserts can be supplied from more than one magazine the pickup unit used to place the inserts can, by predetermined control means such as computer control, select which magazines or even what group of magazines to pick from and load into the web. In that the loading takes place immediately before the package build action there is no wastage of material upstream in the web or assembled for use in the insert supply channel. Indeed, magazines can be replaced without interruption to the package production. Additionally, with a multiple magazine layout the sequence and type variation of inserts can easily be modified with predetermined control. A corollary to type variation is that the placement of the insert within the web can be precisely changed by predetermined control of the range of physicals movement of the placement arm. A wide range of options is made possible by LSI technology not available in the current art of web-based packaging.

It is to be understood that even though numerous characteristics and advantages of the present invention have been set forth in the foregoing description, together with details of the structure, function, and employment of the invention, the disclosures are illustrative only, and changes may be made in details, especially in matters of shape, size, and arrangement of the parts together with content and materials utilized, within the principles of the invention to the full extent indicated by the broad general meaning of the terms are expressed. In particular, the foregoing specification and embodiments are intended to be illustrative and are not to be taken as limiting. Thus, alternatives, such as structural or mechanical or functional equivalents, and other modifications will become apparent to those skilled in the art upon reading the foregoing description.

What is claimed is:

1. A method for placement of an insert in a flexible package, comprising steps for:

folding a segment of flexible web material, the segment having a first sidewall end and a second sidewall end, inside surfaces and outside surfaces, and a fold crease connecting first and second sidewalls;

placing insert into folded segment, insert in contact with inside surfaces, insert registration maintained during package build by gripping means holding insert through segment sidewalls;

joining first and second sidewalls by sealing means at one or more predetermined locations so as to partially define a flexible package containing an insert;

filling the package with a product; and, sealing the first and second sidewalls at predetermined positions so as to completely contain said product and insert within the boundaries of a so defined flexible package.

2. The package of claim 1 wherein gripping means is selected from a group including mechanical, pneumatic, hydraulic, tension and/or combinations thereof.

3. The package of claim 1 wherein sealing means is selected from a group including heat, radiation, mechanical, pressure, light, adhesive and/or combinations thereof.

4. The package of claim 1 wherein said insert is flat or folded.

5. The package of claim 1 wherein said insert is comprised of one or more pieces.

6. The package of claim 1 wherein said insert bears communication.

7. The package of claim 1 wherein product is selected from a group including liquids, fluids, gels, creams, solids, powders, granules, gases, and/or combinations thereof.

8. The package of claim 1 wherein said package is a polymeric packet or pouch or bag.

9. A method for insert placement in a flexible package,
comprising steps for:
aligning first and second sidewalls of flexible web material,
both sidewalls having inside surfaces and outside surfaces,
and both sidewalls arranged so inside surfaces face;
placing an insert between the sidewalls,
insert in contact with inside surfaces,
insert registration maintained during package build by gripping means applied through sidewalls to insert;
joining sidewalls by sealing means at one or more predetermined locations so as to partially define a flexible package containing an insert;
filling the package with a product; and,
joining sidewalls by sealing means at one or more predetermined locations to completely encase said product and insert within the boundaries of a so defined flexible package.

10. The package of claim 9 wherein said flexible web material is one or more polymeric film, paper, foil and/or combination thereof.

11. The package of claim 9 wherein said insert is flat or folded.

12. The package of claim 9 wherein said insert is comprised of one or more pieces.

13. The package of claim 9 wherein said insert bears communication.

14. The package of claim 9 wherein sealing means is selected from a group including heat, radiation, mechanical, pressure, light, sound, adhesive and/or combinations thereof.

15. The package of claim 9 wherein gripping means is selected from a group including mechanical, pneumatic, hydraulic, tension and/or combinations thereof.

16. The package of claim 9 wherein product is selected from a group including liquids, fluids, gels, creams, solids, powders, granules, gases, and/or combinations thereof.

17. The package of claim 9 further including the optional step of attaching the insert to at least one interior wall as part of the package build following insert insertion.

18. A method for placement of an insert in a flexible package,
comprising steps for:
folding a segment of flexible web material,
the segment having a first sidewall end and a second sidewall end,
inside surfaces and outside surfaces,
and a fold crease connecting first and second sidewalls;
placing insert into folded segment,
insert in contact with inside surfaces,
insert registration maintained during package build by gripping means holding insert through segment sidewalls;
joining first and second sidewalls by sealing means at one or more predetermined locations so as to substantively define a flexible package containing an insert.

19. The package of claim 18 further including the step of placing a product with insert before joining first and second sidewalls to fully enclose both insert and product within the boundaries of a so defined flexible package.

20. The package of claim 18 further including the optional step of attaching the insert to at least one interior wall as part of the package build following insert insertion.

21. The package of claim 18 wherein said package is polymeric packet or pouch or bag.

22. The package of claim 18 wherein gripping means is selected from a group including mechanical, pneumatic, hydraulic, tension and/or combinations thereof.

23. The package of claim 18 wherein sealing means is selected from a group including heat, radiation, mechanical, pressure, light, adhesive and/or combinations thereof.

* * * * *